US006196473B1

(12) United States Patent
Beeren et al.

(10) Patent No.: US 6,196,473 B1
(45) Date of Patent: Mar. 6, 2001

(54) SPRAY NOZZLE, AND ALSO SPRAY BOOM PROVIDED THEREWITH

(75) Inventors: Joseph Marie Henrie Beeren; Theodorus Antonius Douven, both of Horst (NL)

(73) Assignee: Machinefabriek Gebr. Douven B.V., Horst (NL)

( * ) Notice: Subject to any disclaimer, the term of this patent is extended or adjusted under 35 U.S.C. 154(b) by 0 days.

(21) Appl. No.: 09/297,141

(22) PCT Filed: Oct. 17, 1997

(86) PCT No.: PCT/NL97/00580

§ 371 Date: Jun. 30, 1999

§ 102(e) Date: Jun. 30, 1999

(87) PCT Pub. No.: WO98/18560

PCT Pub. Date: May 7, 1998

(30) Foreign Application Priority Data

Oct. 25, 1996 (NL) ..... 1004366

(51) Int. Cl.[7] ..... B05B 1/16
(52) U.S. Cl. ..... 239/170; 239/172
(58) Field of Search ..... 239/67, 99, 159, 239/170, 172, 71

(56) References Cited

U.S. PATENT DOCUMENTS

| | | | | |
|---|---|---|---|---|
| 4,206,569 | * | 6/1980 | Randolph | 239/170 X |
| 4,557,420 | * | 12/1985 | Boschung et al. | 239/172 X |
| 4,932,232 | | 6/1990 | Ballyns et al. . | |
| 5,134,961 | * | 8/1992 | Giles et al. | 239/71 X |
| 5,653,389 | * | 8/1997 | Henderson et al. | 239/172 X |

FOREIGN PATENT DOCUMENTS

| | | |
|---|---|---|
| 270 117 | 7/1989 | (DE) . |
| 0 373 034 | 6/1990 | (EP) . |

* cited by examiner

*Primary Examiner*—Lesley D. Morris
(74) *Attorney, Agent, or Firm*—Young & Thompson

(57) ABSTRACT

Spray nozzle for a spray boom to be fixed to a crop protection machine or the like. The spray nozzle is fixed on a supply line for spraying a fluid. The spray nozzle consists of a spray nozzle holder and a spray nozzle head. The passage of the inflow aperture to the outflow channel is regulated by means of an electromagnetic coil. Each spray nozzle holder can be controlled individually in a very accurate manner by means of such an electromagnetic shut-off valve situated in the spray nozzle holder. Connection between electric coil and spray nozzle holder is achieved by means of a connecting piece.

5 Claims, 3 Drawing Sheets

SPRAY NOZZLE, AND ALSO SPRAY BOOM PROVIDED THEREWITH

BACKGROUND OF THE INVENTION

The present invention relates to a spray nozzle for spraying liquids.

Such a spray nozzle is generally known in the prior art. It is used on, for example, a spray boom. European Patent Application 0,373,034 describes a method for applying a certain pattern to the ground by a series of electrically operable spray nozzles. Various other control means for controlling the passage of a fluid such as nutrients and crop protection products are known in the prior art. The simplest design is a manually operated, electrical or pneumatic valve which is fitted in the spray boom. It controls all or a number of spray nozzles. Environmental considerations and the waste involved mean that this is no longer the optimum solution. For the fact is that after such a valve has been taken into the switched-off position the downstream spray nozzles can still drip. Besides, with this design it is not possible to control the spray nozzles separately, which can be important if a piece of land extends at an angle relative to the direction of movement of the spray boom.

A first proposal for overcoming this problem is to fit a pneumatic piston-cylinder in the spray nozzle holder. In this case the piston operates a diaphragm which in the unexcited state provides for a shut-off in the passage from the supply line to the spray nozzle head in the spray nozzle holder. This means that it is possible in principle to control each spray nozzle head separately. However, there are at least two disadvantages involved in such a construction. First, the control by means of a diaphragm is relatively sluggish, which is of minor importance if large quantities of fluid have to be sprayed, but if very small quantities have to be dispensed for a short period, it does play an important role. Besides, an extremely large number of components is necessary for separate control. For such separate control will in the first instance be on the basis of electrical signals, which electrical signals have to be converted into pneumatic signals. Moreover, a separate compressor has to be fitted on the crop protection machine, or has to be present elsewhere.

SUMMARY OF THE INVENTION

The object of the present invention is to avoid these disadvantages and to provide a spray nozzle which can be driven electrically, but in the case of which a spray nozzle can also be produced in a simple manner, using existing components as far as possible. In other words, an electrically operable spray nozzle can be the characterizing part of claim 1.

The invention can be achieved by combining existing spray nozzles which are suitable for hydraulic use with an electric coil, and interposing a connecting piece. In an advantageous embodiment, said connecting piece can be provided with a pipe section which abuts the outflow aperture in a sealing manner at the position of that common face, and which is connected to the valve chamber.

In an embodiment in which large quantities of fluid have to be displaced, the outflow aperture can comprise a main and auxiliary outflow channel. In such a case the electromagnetic valve acts as the control valve, i.e. by operation of this valve a further valve, and in particular a diaphragm valve, is controlled.

The embodiments described above are embodiments which in the unexcited state of the electromagnetic coil provide a shut-off. Of course, it is possible to design the device the other way round, i.e. in the unexcited state the passage to the spray nozzle head is opened.

With the construction described above, it is no longer necessary to incorporate valves in the supply line, and it is also possible to control the spray nozzles individually. Furthermore, the time during which the various spray nozzles are active can be varied over a spray boom. This can be important if, for example, in the case of a piece of land to be treated the direction of movement of the spray boom is at an angle relative to the boundary of the piece of land. Another exemplary application is that in which the conditions over the entire area of the piece of land concerned are not the same, i.e. at certain points fluid has to be applied and at other points less or no fluid at all has to be applied. The above can also depend on the crops present in that place, and can be regulated by means of sensors, possibly combined with GPS and D-GPS and a control system fitted specially for the purpose.

With the current techniques it is possible to use extremely low-capacity electromagnetic coils. A value of 4, 5 or 8 watts has been found possible, so that the total power consumption of a spray boom with several dozen spray nozzles is relatively low.

The invention also relates to a spray boom provided with the spray nozzles described above.

It is possible to incorporate a return line or continuous recirculation line for fluid in the above spray boom.

BRIEF DESCRIPTION OF THE DRAWINGS

The invention will be explained in greater detail below with reference to exemplary embodiments shown in the drawing, in which.

DESCRIPTION OF THE PREFERRED EMBODIMENTS

Figure 1:
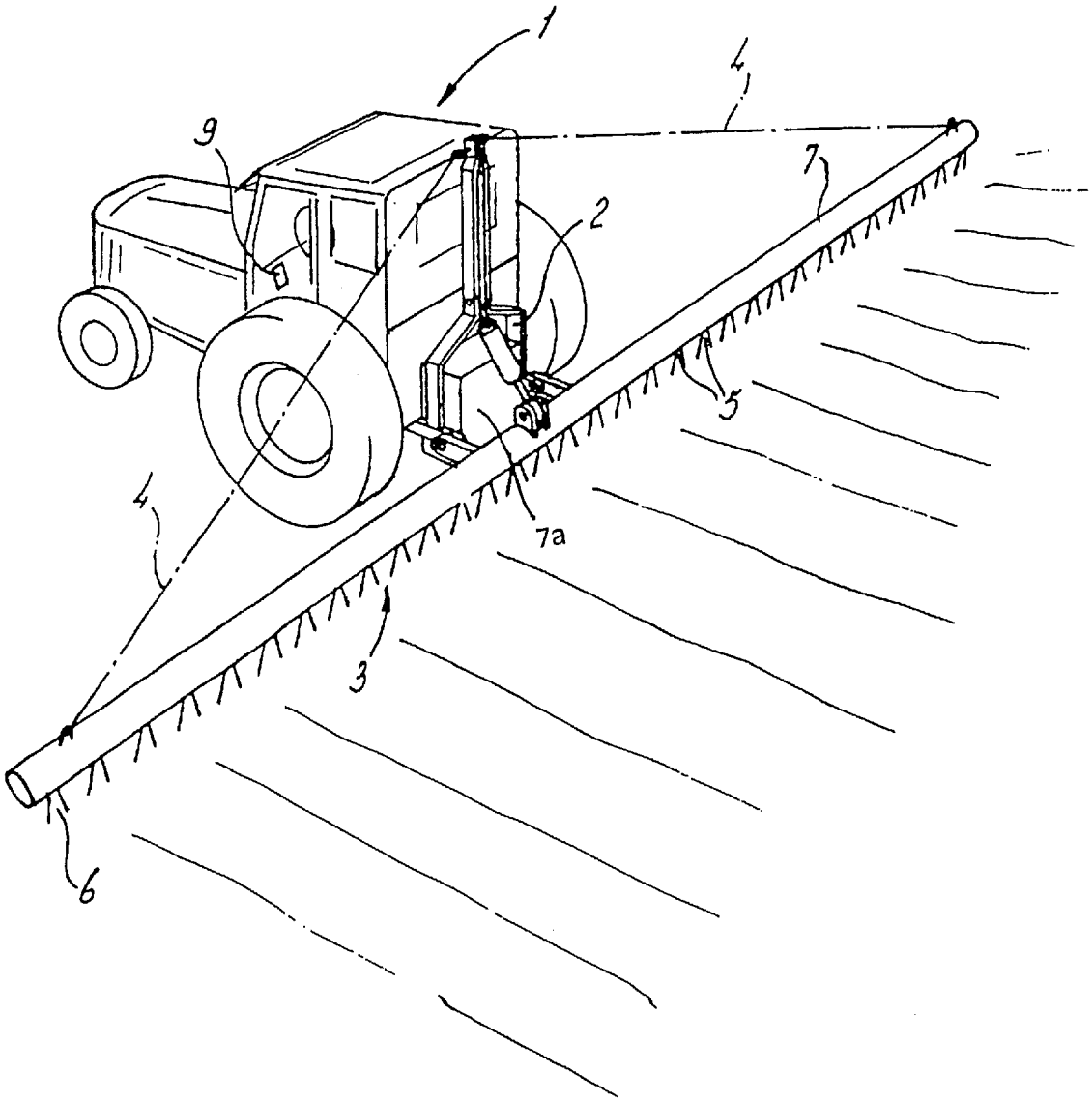
FIG. 1 shows in perspective view a crop protection machine.

FIG. 1 shows a tractor 1 which is provided near the rear side with a bearer 2 on which a spray boom 3 is fixed, in the usual manner. The crop protection machine consists of a container 7*a* for fluid, which is conveyed by way of a supply line 7 to various spray nozzles 5, 6. In this case spray nozzle 6 is a so-called edge nozzle, i.e. the spray profile does not extend beyond the end limit of spray boom 3. Spray boom 3 is suspended from a cable 4 or the like. It is not shown in FIG. 1 that a return line may be present for conveying fluid from the supply line 7 back to container 7*a,* in order in this way to avoid effects of air during starting and the like and to improve bringing to concentration or flushing. Tractor 1 also has a control 9 which is connected by means of cables (not shown) to the spray nozzles 5 and 6.

Figure 2:
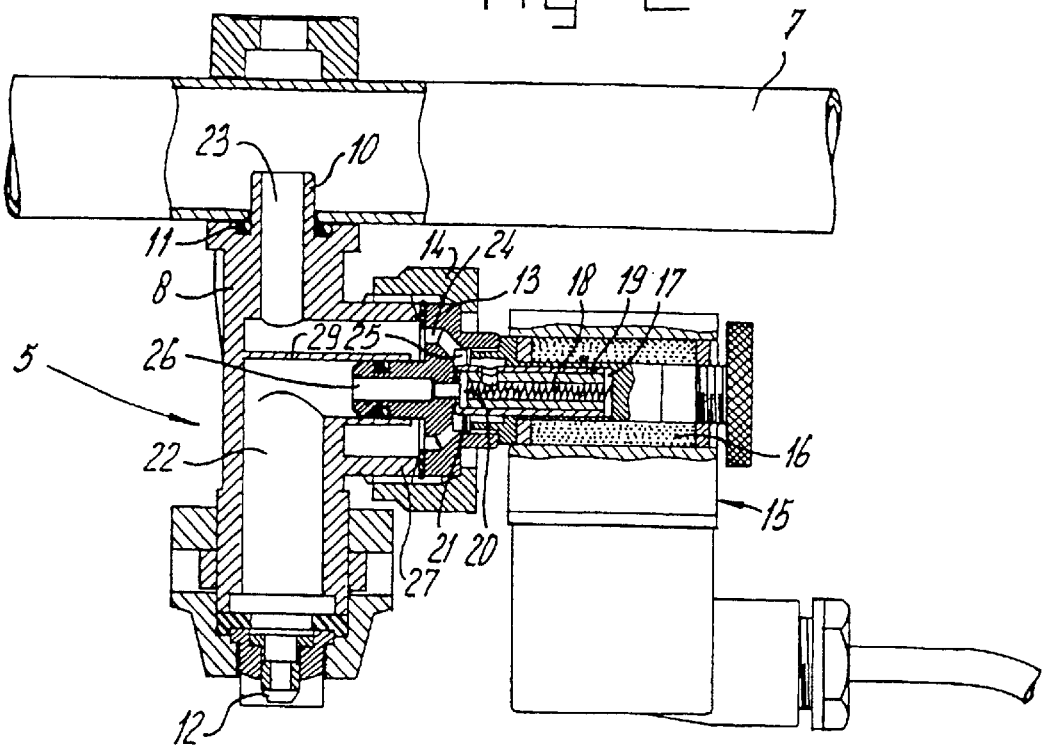
FIG. 2 shows a first embodiment of a spray nozzle.

FIG. 2 shows a first exemplary embodiment of a spray nozzle. The spray nozzle indicated by 5 is fixed on supply line 7. Said spray nozzle consists of a spray nozzle holder 8, which is provided with an inlet 10 projecting slightly into supply line 7. The seal is achieved by part 11. Spray nozzle head 12 is fixed on holder 8. It should be understood that any type of spray nozzle head can be used. Moreover, instead of the spray nozzle holder/spray nozzle head described here, it is also possible to use a device consisting of a number of spray nozzle heads which are fitted by means of a revolvertype construction on the spray nozzle holder, so that the correct spray nozzle head can be selected depending on the conditions in which spraying has to be carried out and the fluid which has to be sprayed.

The spray nozzle holder 8 and spray nozzle head 12 are conventional, commercially available components. Spray nozzle holder 8 is provided with a flange 27 for the accommodation of a connecting piece 13. Spray nozzle holder 8 and connecting piece 13 can be fixed to each other by means of a union nut 14. An armature housing 17 is screwed into connecting piece 13, over which armature housing a coil 15 is pushed. Coil 15 consists of a winding 16 which is electrically connected to control 9. Inside armature housing 17 is an armature 19 which can move to and fro. A spring 18 is present, which spring drives said armature to the left in the unexcited state. Armature 19 is provided with a sealing face 20 at the free end.

Spray nozzle holder 8 is provided with an inflow channel 23, which by way of a number of supply channels 24 fitted in a circle opens out into a valve chamber 25. From there, a centrally situated outflow aperture 26 extends through a pipe section 29, which outflow aperture opens out into outflow channel 22 which is in communication with spray nozzle head 12. Seal 20 of armature 19 is designed to interact with the valve seat 21.

On excitation of coil 15, armature 17 will move to the right and the fluid can flow unimpeded out of supply line 7 to spray nozzle head 12. If closure is desired, particularly rapid closure of aperture 26 can be obtained by no longer exciting the coil. No subsequent dripping is found. Coil 15 can have a relatively low power consumption in the excited state, such as 4, 5 or 8 watts. All kinds of spray patterns can be achieved by means of the control. In particular, any desired pattern can be achieved near the end of the spray boom by interaction of the edge spray nozzle 6 with the adjacent spray nozzle 5. Furthermore, selective spraying is possible, and the number of components is relatively small. In particular, owing to the extremely high switching speed, spraying per plant is now achievable, i.e. the spray does not fall between two plants.

Figure 3:
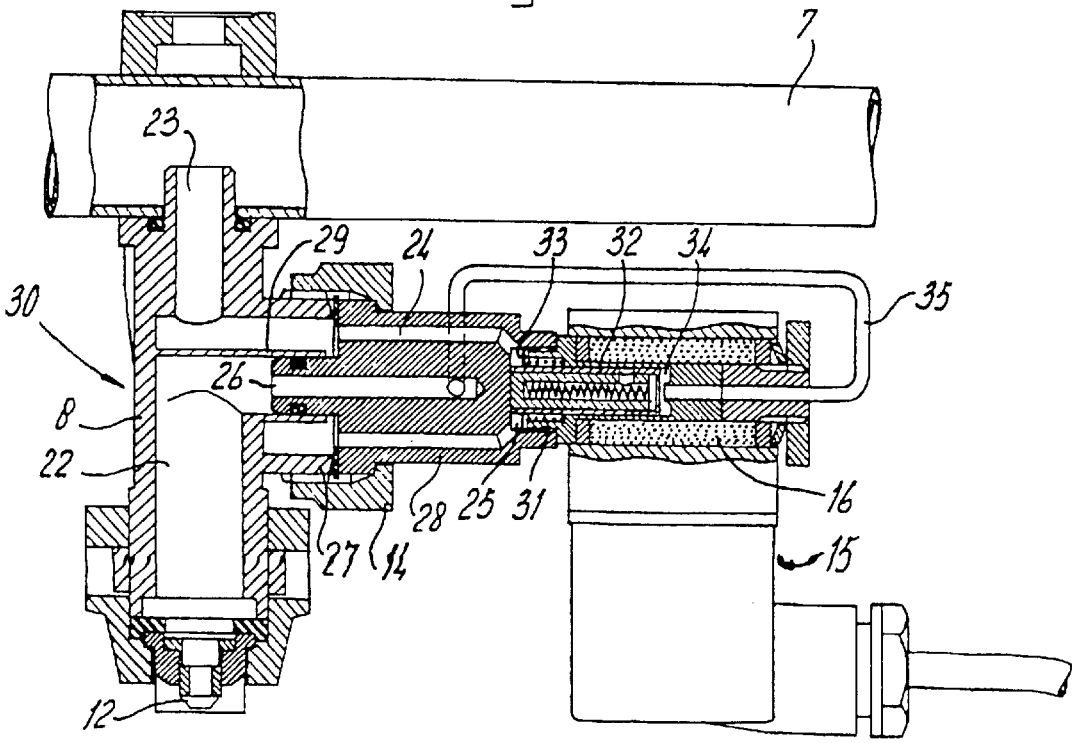
FIG. 3 shows a second embodiment of a spray nozzle.

FIG. 3 shows a variant of the construction shown in FIG. 2. This spray nozzle is indicated in its entirety by 30. The spray nozzle holder is indicated by 8, as in FIG. 2, because it is largely identical. Differences exist only as regards the control section and the connecting piece 28. This embodiment is designed in such a way that in the normal unexcited state of winding 16 a free passage opening is present between supply line 7 and spray nozzle head 12.

This is achieved by the fact that armature 32 is provided with a ring 33 which is immovably connected thereto and is under the influence of a spring 31. In the unexcited state, armature 32 will be moved to the left, as shown in FIG. 3, and valve chamber 34 will be opened, thereby providing a communication by way of bypass line 35 between inflow channel 23 and outflow channel 22. In this construction also, use can be made of existing spray nozzle holders and spray nozzle heads respectively.

Figure 4:
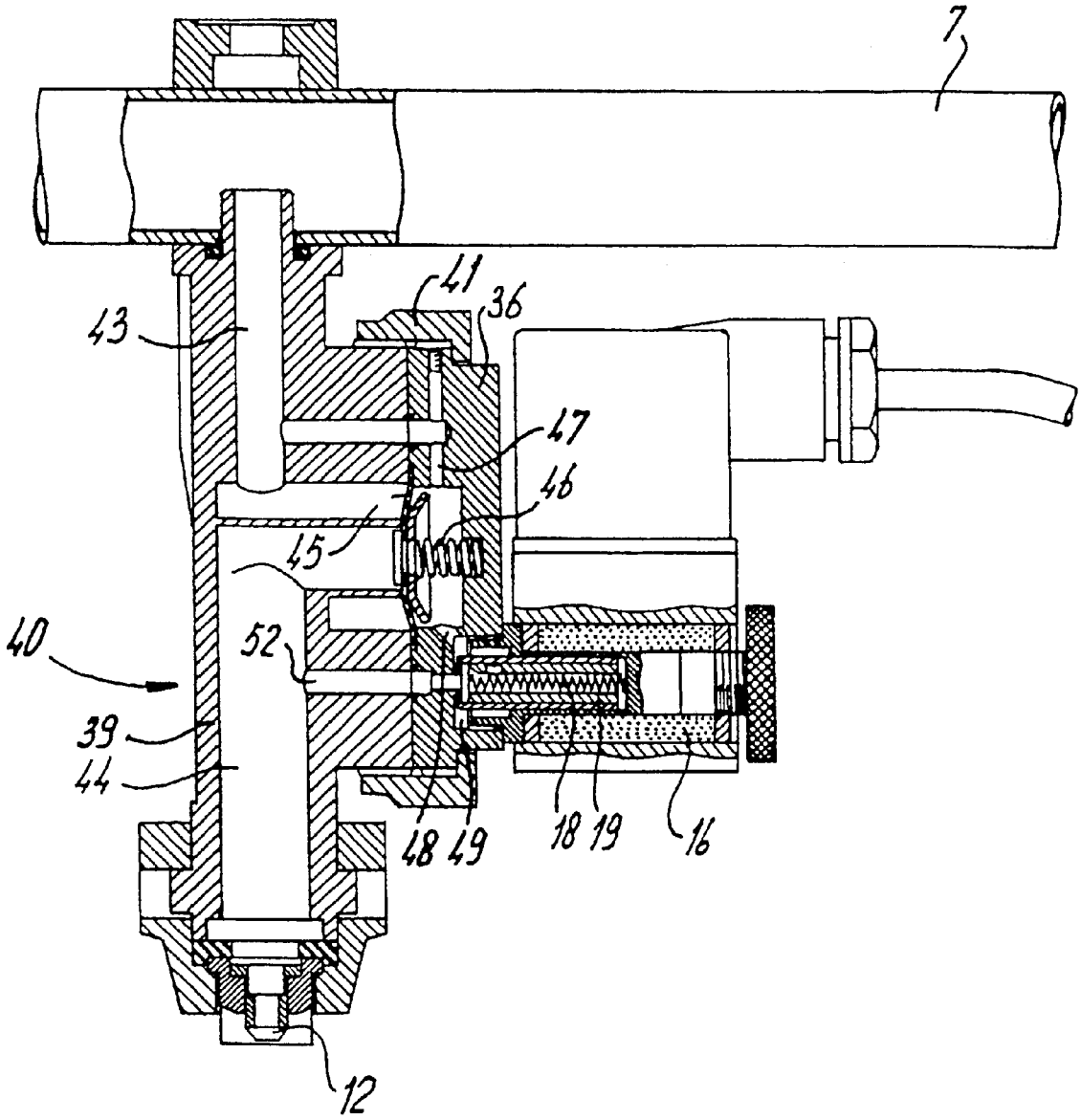
FIG. 4 shows a third embodiment of a spray nozzle.

FIG. 4 shows a construction which is suitable in particular for dispensing large quantities of fluid. This spray nozzle is indicated in its entirety by 40 and consists of a spray nozzle holder 39. A relatively large union nut 41 is fitted on the connecting piece thereof, for the accommodation of connecting piece 36. Apart from coil 16, a diaphragm 45 loaded by a spring 46 is also present, shutting off the main aperture between inflow channel 43 and outflow channel 44. Inflow channel 43 is connected to a calibrated control channel 47, which by way of inlet channel 48 and valve chamber 49 is in communication with main outflow channel 52 with larger passage. In the manner shown in FIG. 1, an electromagnetic coil is present, consisting of winding 16, spring 18 and armature 19. In the unexcited state, auxiliary outflow channel is closed. This is caused by the fact that spring 18 drives armature 19 into the closed position. Owing to the small surface of armature 19 which is exposed to the fluid pressure acting in supply line 7, it is possible with a relatively light spring to ensure closure of the plunger even at higher pressures. Diaphragm 45 is kept closed by the combined action of the fluid pressure and spring 46. If excitation is then provided, fluid will move through the auxiliary flow channel to spray nozzle head 12. Owing to the fact that the aperture of the calibrated control channel 47 is smaller than the aperture of the auxiliary outflow channel 52, fluid will be discharged at a more rapid rate than its rate of inflow. This causes the pressure at the right-hand side of the diaphragm 45 to drop, and the diaphragm can open against the action of spring 46. The surface exposed to the pressure in the supply line consequently increases further, and the valve will remain opened so long as armature 19 makes discharge of fluid possible, with the result that spray nozzle head 12 will spray the medium.

It is, of course, clear that the construction shown in FIG. 3, which in the unexcited state is opened, can also be used for the construction shown with reference to FIG. 4.

Although the invention is described above with reference to a preferred embodiment, it will be understood that numerous variants thereof are possible without going beyond the scope of the present application.

As indicated above, it is possible to achieve an embodiment of the spray nozzle holder which is particularly suitable for electromagnetic operation, in which case then new moulds for the injection moulding work are necessary.

These and other proposals are considered to lie within the scope of the appended claims.

What is claimed is:

1. A spray nozzle for spraying fluids, the spray nozzle being provided with electrical operating means, said spray nozzle comprising, a spray nozzle head, and a spray nozzle holder provided with an inflow aperture and an outflow aperture, which open out in a common face, and a flange having a circumferential screwthread;

said electrical operating means comprising a coil, with an armature which is movable in a linear manner, one end of said armature being connected to a valve body fitted in a valve chamber, in which a connecting piece is present, placed between said spray nozzle holder and said coil at said common face, said connecting piece comprising separate inflow and outflow channels and being provided with a union nut to cooperate with said circumferential screwthread, and in which said valve chamber is provided in at least one of said connecting piece and said electrical operating means.

2. The spray nozzle according to claim 1, in which said connecting piece is provided with a pipe section which abuts the outflow aperture in a sealing manner at the position of said common face, and which is connected to said valve chamber.

3. The spray nozzle according to claim 1, in which the outflow aperture comprises main and auxiliary outflow channels.

4. The spray nozzle according to claim 1, in which said electrical operating means in the excited state consume less than 10 W.

5. A spray boom fixed to a crop protection machine or the like, comprising at least one supply line for the fluid stored in a container to be sprayed, and also a number of spray nozzles fitted on the supply line, wherein each spray nozzle is provided with electrical operating means, each said spray nozzle comprising, a spray nozzle head, and a spray nozzle holder provided with an inflow aperture and an outflow aperture, which open out in a common face, and a flange having a circumferential screwthread;

said electrical operating means comprising a coil, with an armature which is movable in a linear manner, one end of said armature being connected to a valve body fitted in a valve chamber, in which a connecting piece is present, placed between said spray nozzle holder and said coil at said common face, said connecting piece comprising separate inflow and outflow channels and being provided with a union nut to cooperate with said circumferential screwthread, and in which said valve chamber is provided in at least one of said connecting piece and said electrical operating means.

* * * * *